United States Patent [19]

Green

[11] Patent Number: 5,020,753

[45] Date of Patent: Jun. 4, 1991

[54] SOAP HOLDER

[76] Inventor: William P. Green, 3570 E. Lombardy Rd., Pasadena, Calif. 91107

[21] Appl. No.: 358,000

[22] Filed: May 30, 1989

[51] Int. Cl.[5] ..... F16M 11/00

[52] U.S. Cl. ..... 248/176; 248/309.2; 248/686

[58] Field of Search ..... 248/682, 683, 684, 686, 248/176, 309.2; 252/92, 134, 174, DIG. 16

[56] References Cited

U.S. PATENT DOCUMENTS

| | | | |
|---|---|---|---|
| 711,403 | 10/1902 | Klein et al. . | |
| 717,256 | 12/1902 | Nilsson . | |
| 740,440 | 10/1903 | Jones . | |
| 768,731 | 8/1904 | Brown . | |
| 2,586,626 | 2/1952 | Dunn | 248/309.2 |
| 3,094,806 | 6/1963 | Rodrigo | 248/682 |
| 3,315,933 | 4/1967 | Tatham | 248/309.2 |
| 3,325,133 | 6/1967 | Bertges | 248/309.2 X |
| 3,886,987 | 6/1975 | Schuchman . | |
| 4,177,965 | 12/1979 | Blaszkowski | 248/686 |
| 4,309,014 | 1/1982 | Blaszkowski | 248/686 |

FOREIGN PATENT DOCUMENTS

| | | | |
|---|---|---|---|
| 1023571 | 1/1958 | Fed. Rep. of Germany | 248/684 |
| 484225 | 9/1917 | France | 248/682 |
| 750107 | 8/1933 | France | 248/686 |
| 461820 | 7/1951 | Italy | 248/309.2 |
| 312118 | 12/1955 | Switzerland | 248/683 |

*Primary Examiner*—David L. Talbott

*Attorney, Agent, or Firm*—William P. Green

[57] ABSTRACT

A soap holder having a projection adapted to extend into a recess in a bar of soap in a manner supporting the bar from its interior to avoid or minimize contact of the outer surfaces of the bar of soap with supporting surfaces. The bar may contain an element embedded within the soap and adapted to engage the projection to limit movement of the soap onto the projection and assist in supporting the bar in proper position.

26 Claims, 3 Drawing Sheets

SOAP HOLDER

This invention relates to devices for supporting a bar of soap.

BACKGROUND OF THE INVENTION

When a bar of soap is placed on a conventional soap dish, soap holder or other supporting surface after use, the engagement of the undersurface of the soap with the support prevents effective drying of that undersurface and maintains it for a long period of time in a softened mushy condition. Subsequent handling of the soap tends to rapidly rub or wear away the softened surface of the soap, and as a result the soap does not last as long as it should. Various expedients have been proposed to overcome or reduce this effect. For example, soap dishes have been provided with openings for draining away water, or with soap contacting surfaces having spaced ridges, grooves or other irregularities or specially formed shapes. Also, waterproof sheets, coatings or covers have been provided on the soap itself to render one or more of the outer surfaces of the soap insoluble in water. However, none of these prior proposals of which I am aware is an effective solution to the problem.

SUMMARY OF THE INVENTION

The general purpose of the present invention is to provide a holder which supports a bar of soap in a manner leaving most or all of its exterior surfaces uncontacted by the holder. The outer surfaces of the soap can then dry very rapidly after use, and thus return to their initial hard condition maximizing the effective length of life of the soap.

To achieve these results, the holder has a projection which extends into a recess formed in the soap, in a manner supporting the soap primarily or entirely from its interior. In a presently preferred form of the invention, the soap carries an element which is engageable with the supporting projection at a location within the recess to support the soap from the projection through that element. The element may be embedded within the bar of soap, desirably at essentially its center of gravity, and be disposed at least partially across the recess and have a shoulder engageable with a shoulder on the projection to limit movement of the soap onto the projection. The recess in the soap preferably takes the form of a passage extending entirely through the thickness of the bar, between opposite side surfaces thereof, to enable the projection to enter the passage from either end.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
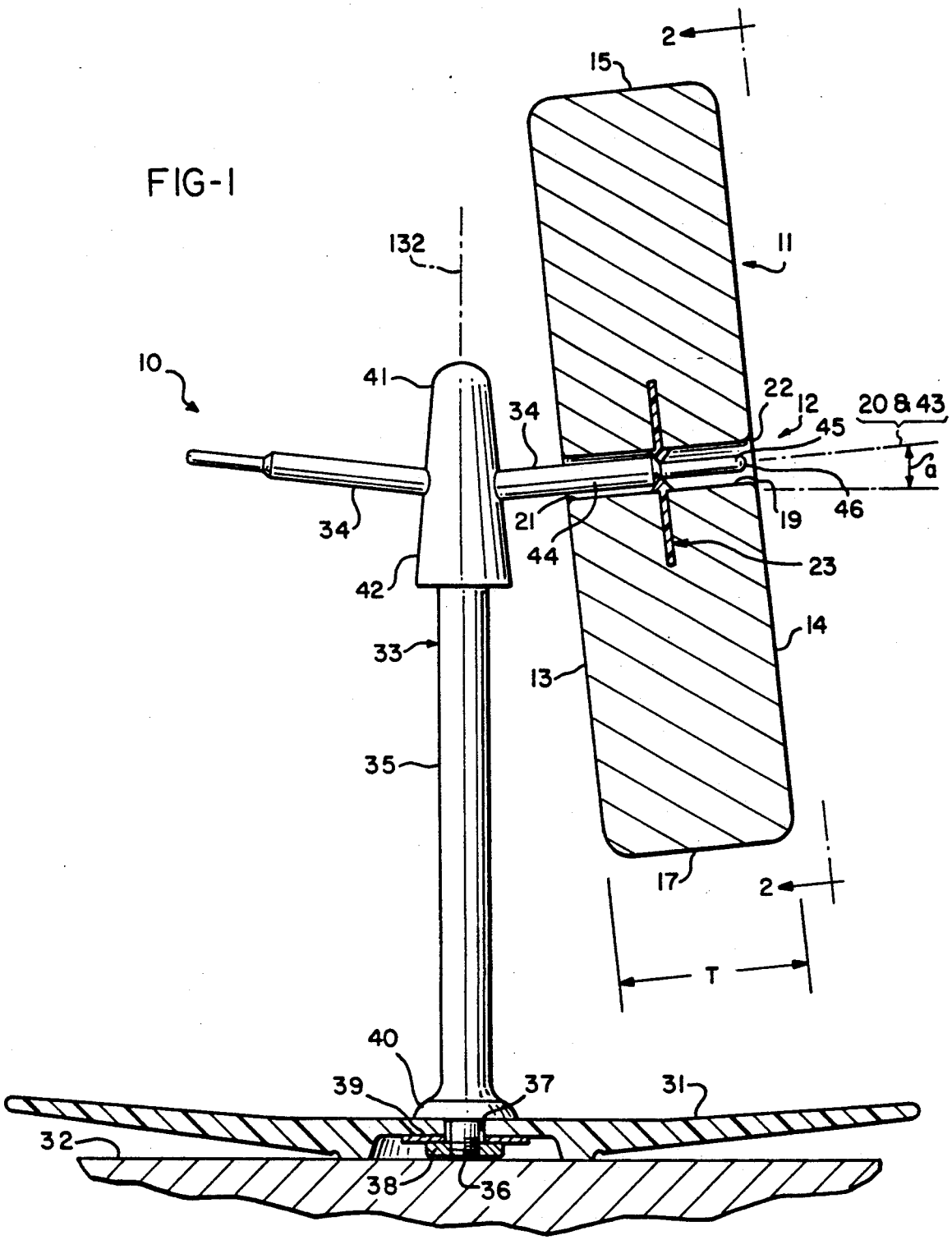
FIG. 1 is a vertical central section through a first form of soap holder constructed in accordance with the invention.
Figure 2:
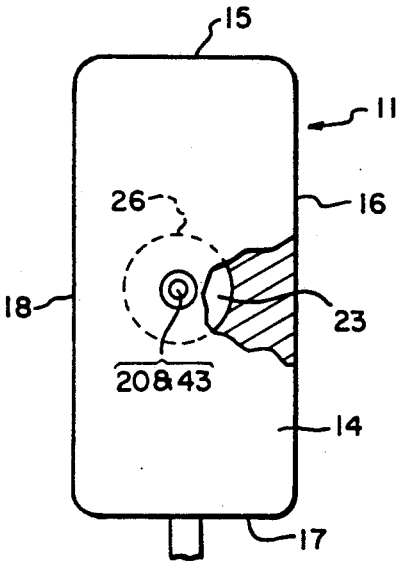
FIG. 2 is a reduced elevational view taken on line 2—2 of FIG. 1.

FIG. 1 illustrates a first form of holder 10 for supporting a bar of soap 11 in a manner minimizing contact of the external surfaces of the soap with the holder. The bar of soap 11 is typically illustrated as rectangular in shape and completely conventional except as it is adapted at its central region 12 for connection to holder 10. Bar 11 may have two parallel planar opposite side surfaces 13 and 14, having the rectangular shape illustrated in FIG. 2, with planar edge surfaces 15, 16, 17 and 18 extending between side surfaces 13 and 14 and perpendicular thereto. A recess 19 is formed in the center of bar 11, and preferably takes the form of a cylindrical passage extending between opposite side surfaces 13 and 14 and centered about an axis 20 perpendicular to those surfaces. Axis 20 of passage 19 extends through the center of each of the side surfaces 13 and 14, so that passage 19 is also centered with respect thereto. At its opposite ends, passage 19 may flare slightly as seen in FIG. 1, to provide annular rounded tapering entrance throats or surfaces 21 and 22. At the center of the thickness dimension T of bar 11 between its opposite side surfaces 13 and 14, an element 23 is embedded within the soap. This element may be formed of any appropriate material, preferably a suitable essentially rigid or stiff resinous plastic material which will maintain its integrity and shape and will not dissolve or be otherwise adversely affected when contacted by water during use of the soap. For example, element 23 may typically be formed of polyethylene, polypropylene, nylon, polystyrene, polyvinyl chloride, polyurethane or the like. Element 23 may have an outer flat portion 24 disposed parallel to surfaces 13 and 14 and perpendicular to and centered about axis 20. The central plane 25 of element 23 is preferably located midway between the two surfaces 13 and 14, to thus be located at the center of the thickness dimension of the bar of soap. As seen in FIG. 2, the outer edge 26 of element 23 may be circular about axis 20. Element 23 has a radially inner portion 27 (FIG. 3) received within passage 19 and containing a central opening 28 which may be circular about axis 20. Portion 27 of element 23 thus forms an annular shoulder structure within passage 19 which is thicker axially than the radially outer portion 24 of element 23. At its opposite axial sides, portion 27 has two annular camming or entrance throat surfaces 29 and 30 which taper toward one another and toward opening 28 and may be of frustroconical configuration centered about axis 20. The geometric center and the center of gravity of the bar of soap 11, including its carried element 23, are preferably at the center of element 23 as represented by the letter G in FIG. 3.

Holder 10 of FIG. 1 has a base portion 31, adapted to be placed on a horizontal supporting surface 32 of a wash basin, counter, or the like. In the FIG. 1 arrangement, this base 31 takes the form of a circular dish centered about a vertical axis 32 and providing a receptable beneath the bar of soap 11 for receiving water which may drip from the soap or from a person's hands. A support 33 projects upwardly from dish 31 and carries one or more projections 34 (typically two such projections as illustrated) for engagement with the bar of soap. Support 10 may have a lower vertically extending cylindrical portion 35 centered about axis 32 and having a lower threaded end 36 extending through a central opening 37 in the dish. A nut 38 connected onto threaded end 36 and tightened upwardly against a washer 39 clamps the central portion of the dish between the nut and an annular flange portion 49 of support 33 to hold that support in rigidly fixed position relative to the dish.

At its upper end, support 33 has an enlarged portion 41 with an upwardly tapering frustroconical external surface 42 centered about axis 32. Projections 34 are attached rigidly to or formed integrally with the upper enlarged portion 41 of support 33, and project in essentially opposite directions therefrom. As each of the projections extends horizontally outwardly from portion 41 of the support, the projection advances gradually upwardly along an axis 43 which is disposed at a slight upward angle a with respect to the horizontal, and which is essentially coincident with the previously discussed central axis 20 of the soap in the FIGS. 1 to 4 position of the soap relative to the holder. Each projection 34 has a first preferably cylindrical larger diameter portion 44 centered about axis 43 and a second smaller diameter preferably cylindrical portion 45 also centered about that axis and continuing to the extremity 46 of the projection. The external diameter of portion 44 of the projection may be slightly less than the internal diameter of passage 19 for reception therein, but is larger than the diameter of opening 28 in element 23. The external diameter of portion 45 of the projection is just slightly less than the internal diameter of opening 28 in element-ment 23, to extend therethrough. The extremity 46 of the projection may be rounded spherically as shown, to serve as a tapering camming surface centered about axis 43 and engageable with surface 28 or 30 in camming relation to center projection 34 within opening 28 as the soap is moved onto the projection. An annular shoulder surface 47 is formed on each of the projections 34 between its two different diameter portions 44 and 45, to engage surface 29 or 30 in the position of FIG. 1 and thus limit the extent to which the bar of soap 11 can be moved onto the projection. Shoulder surface 47 is centered about axis 43 and preferably tapers frustroconically at the same angle as surfaces 29 and 30 to abut against one of those surfaces in the FIG. 1 position of the soap.

When the bar of soap 11 of FIGS. 1 to 4 is to be placed in use, a person grasps the bar in one of his hands and pulls it rightwardly as viewed in FIG. 1 relative to holder 10 and along axis 43. The bar thus moves off of the projection and can be handled in conventional manner. As water contacts the outer surfaces 13 through 18 of the soap, the soap material gradually dissolves at those surfaces in conventional manner. The soap may also dissolve slightly within passage 19, but element 23 of course does not dissolve and is not affected by the water, and can be utilized to support the soap on projection 34 even after the soap itself has been reduced substantially in size from use. Element 23 also assists in reinforcing and maintaining the shape of the bar of soap at its center.

After each use, the bar of soap is moved leftwardly (as viewed in FIGS. 1 and 3) along axis 43 onto projection 34, so that the projection extends into the left end of passage 19, with the reduced diameter portion 45 of the projection moving into opening 28 of element 23, and with the soap ultimately reaching the position of FIG. 1 in which surface 29 or 30 on portion 27 of element 23 engages shoulder 47 on the projection at approximately the center of gravity G of the soap bar, and prevents further movement of the bar onto the projection. As previously indicated, the slight inclination of projection 34 maintains the bar of soap on projection 34 and against shoulder 47, and in that supported position the inner side surface 13 of the bar remains spaced from surface 42 and all other surfaces of the holder. The external surfaces of the bar are thus all exposed directly to air, and may rapidly dry and harden to be in optimum condition for the next use. It is also noted that, though each projection 34 and its axis 43 are preferably inclined as discussed to assist in maintaining the soap by gravity on the projection, the angle a of inclination is desirably relatively small, preferably not over about 20 degrees and for best results not over about 10 degrees, with the projection therefore extending generally horizontally, so that as a user moves the soap onto the projection, the end of passage 19 which is to receive the projection faces generally horizontally toward the projection and is readily visible to the user to enable him or her to visually locate or align the projection with the passage.

Figure 5:
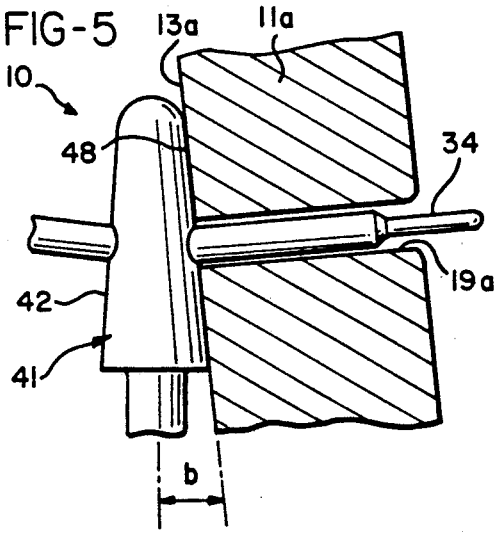
FIG. 5 is a fragmentary vertical section corresponding to a portion of FIG. 1, but showing the holder as used with a different and simpler type of bar of soap.

FIG. 5 illustrates a variational bar of soap 11*a* which may be utilized with the holder 10 in lieu of bar 11 of FIG. 1. In this FIG. 5 arrangement, the element 23 of FIG. 1 is omitted to reduce the cost of the soap. Passage 19*a* in bar 11*a* of FIG. 5 may be otherwise identical with passage 19 of the first form of the invention, to receive one of the projections 34 of holder 10 when the soap is supported on the projection. Movement of bar 11*a* onto the projection is limited by engagement (at 48) of its left side surface 13*a* with the upwardly tapering surface 42 of portion 41 of holder 10. This contact at 48 may be over a very limited area, preferably line contact as shown. To attain such line contact, the angle b between upwardly tapering surface 42 and the vertical should be equal to the previously mentioned angle a of FIG. 1.

Figure 6:
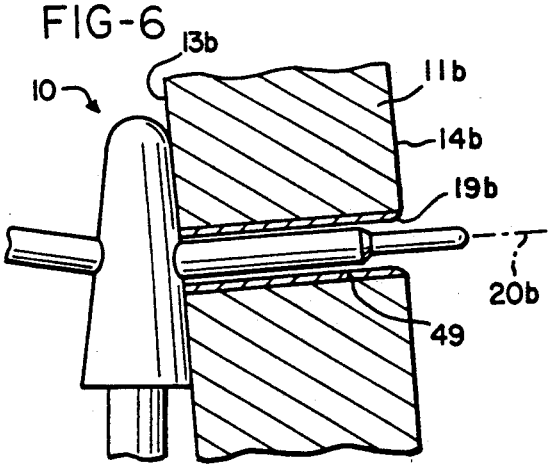
FIGS. 6, 7, 8, 9 and 10 are fragmentary vertical sections through several variational embodiments of the invention.

FIG. 6 illustrates the holder 10 of FIGS. 1 through 5 as utilized with another different bar of soap 11*b*. This bar 11*b* contains an inner passage 19*b* similar to but slightly larger in diameter than passage 19 of the first form of the invention Passage 19*b* is perpendicular to the opposite side surfaces 13*b* and 14*b* of the bar of soap, and is cylindrical about axis 20*b*. Passage 19*b* is lined by an internally and externally cylindrical liner 49 formed of a material which is not soluble in water, and which will thus protect the soap at cylindrical passage 19*b* from contact with water and assist it in maintaining its integrity as the soap is used and its outer surfaces 13*b*, 14*b*, etc. are gradually dissolved away. The liner 49 may be formed as an inner coating of water insoluble material, such as paraffin, applied to the interior of the passage in melted form and then allowed to cool and harden. Alternatively, the liner 49 may be preformed as a thin walled tube and be inserted in that form into passage 19*b*, with the liner being retained in that position either by friction or by an appropriate adhesive. The soap 11*b* of FIG. 6 is utilized in the same manner as the bar 11*a* of FIG. 5, but with the wall of passage 19*b* being protected by liner 49 against enlargement by contact with water during use.

Figure 7:
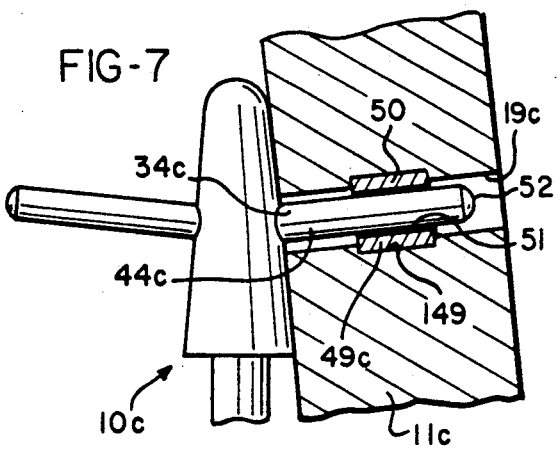

FIG. 7 shows another arrangement which is similar to FIG. 6, and which has a tubular internally and externally cylindrical liner 49*c* of water insoluble material contained within passage 19*c* in the bar 11*c* of soap. The liner 49*c* of FIG. 7 does not extend through the entire thickness of the bar of soap, but rather is located only at the center of the bar as shown. The external diameter of outer cylindrical surface 149 of liner 49*c* may be slightly greater than the diameter of passage 19*c*, so that the liner projects radially outwardly into a groove 50 in the soap to mechanically lock the liner in position. The inner passage 51 in liner 49*c* is cylindrical and of a diameter slightly greater than the external diameter of cylindrical surface 44*c* of one of the projections 34*c* of holder 10*c*. In FIG. 7, the projections are illustrated as not having the terminal reduced diameter portions 45 of FIGS. 1 to 6, but rather as having a uniform diameter along the entire axial extent of each projection, with a spherically rounded extremity 52 at the outer end of the projection. It will of course be understood that if desired the reduced diameter end portion 45 may be provided in FIG. 7, or the reduced diameter portion may be omitted in any of the other arrangements.

Figure 8:
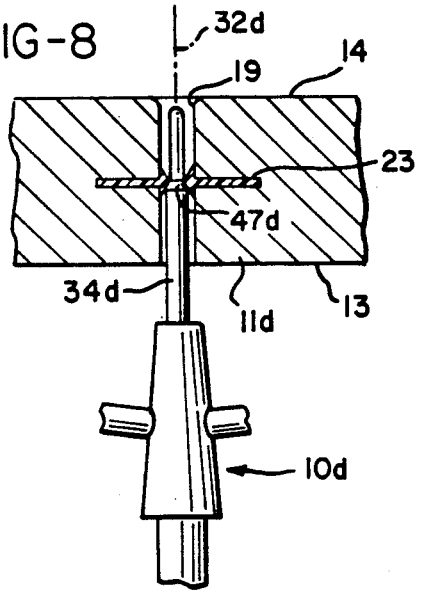

In the form of the invention illustrated in FIG. 8, the holder 10*d* may be the same as holder 10 of the first form of the invention except for provision of an additional projection 34*d* corresponding to projections 34 of FIG. 1 but projecting directly upwardly along and centered about vertical axis 32*d* corresponding to axis 32 of FIG. 1. The bar of soap utilized in FIG. 8 may be the same bar 11 as in FIGS. 1 to 5. In connecting this bar 11 to vertical projection 34*d*, the bar is placed in horizontal position, with its side surfaces 13 and 14 disposed horizontally, and the bar is then moved downwardly along axis 32*d* in a manner causing vertical projection 34*d* to enter passage 19 engage element 23. Shoulder 47*d* on projection 34*d* (corresponding to shoulder 47 of FIG. 3) then engages upwardly against the inner edge portion 27 of element 23, to support the bar of soap in horizontal position. In this condition, it is noted that since the opening in element 23 is at the center of the bar of soap, both horizontally and vertically, the bar is balanced on the projection in its horizontal position. The contact between projection 34*d* and element 23 is at essentially the center of gravity G of the bar of soap including its element 23. As in the first form of the invention, the external surfaces of the bar of soap are maintained out of contact with all portions of the holder 10.

Figure 9:
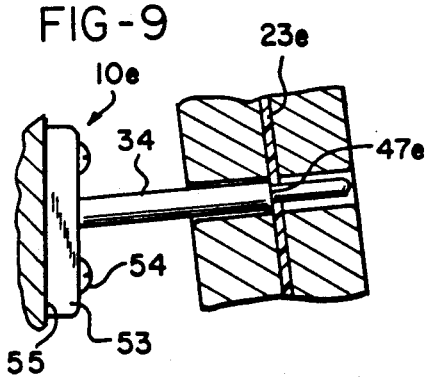

FIG. 9 shows a variation in which a holder 10*e* has a mounting bracket portion 53 adapted to be connected by screws 54 to a wall surface, cabinet surface, or the like 55. The mounting bracket portion of holder 10*e* has a projection 34*e* which may be the same as projections 34 of FIG. 1 except that projection 34*e* is typically illustrated as having a directly transverse annular shoulder surface 47*e* rather than the tapering surface 47 of FIGS. 1 to 5. Element 23*e* of FIG. 9 is flat through its entire radial extent, inwardly to opening 28*e*, and thus forms a transverse stop surface engageable with shoulder 47*e* to limit movement of the soap bar 11*e* onto the projection The engaging stop surfaces of elements 34*e* and 23*e* may of course be tapered if desired, and the corresponding surfaces in the other forms of the invention may extend directly transversely as in FIG. 9 if preferred.

Figure 10:
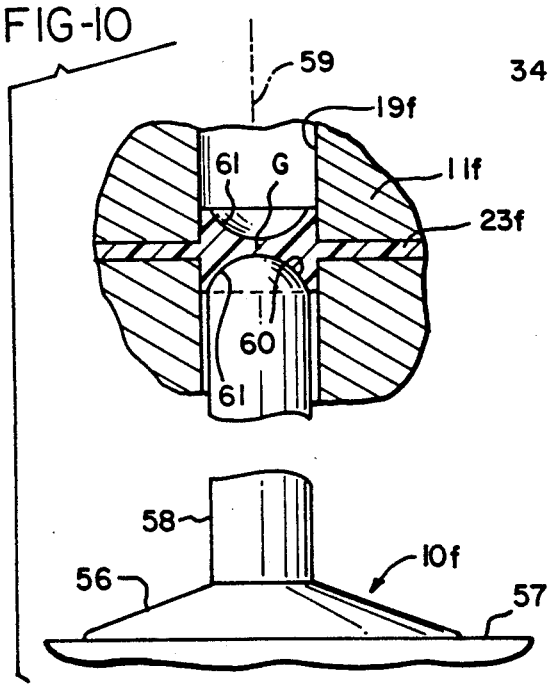

FIG. 10 shows another arrangement in which holder 10*f* has a base portion 56 which is adapted to be placed on a horizontal support surface 57, but which in this instance is typically illustrated as not taking the form of a dish as in FIG. 1. A pedestal 58 projects upwardly from base 56, and may be externally cylidrical and of a diameter slightly less than the diameter of passage 19*f* formed in the bar of soap 11*f*. Pedestal 58 may be centered about a vertical axis 59 and have a spherically curved rounded upper end 60. The bar of soap 11*f* may be identical with the bar 11 of FIG. 1, except that the element 23*f* corresponding to element 23 of FIG. 1 does not contain a central opening and is shaped to have two partial spherical recesses 61 at its opposite sides facing in opposite directions along axis 59. The rounded end 60 of pedestal 58 may have the same spherical curvature as surfaces 61, to engage either of those surfaces in a centered supporting relation as shown. As discussed in connection with FIG. 8, the bar of soap is balanced in horizontally extending condition when mounted on the pedestal 58 of FIG. 10, since the center of gravity G of element 23*f* is at the center of the bar of soap both vertically and horizontally. Stated differently, the point of support of the soap on the upper end of pedestal 52 is at essentially the center of gravity of the bar of soap, or at least is in vertical alignment with the center of gravity, to maintain an effectively balanced condition of the soap on the pedestal.

Figure 11:
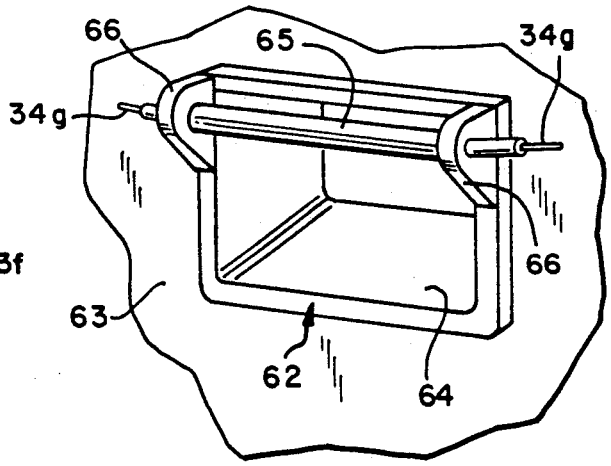
FIG. 11 is a perspective view of a variational soap holder to be mounted in the wall of a shower or tub area.

FIG. 11 shows a variation including a soap holder 62 of the general type commonly mounted in a recess in a vertical wall 63 of a shower or tub area. Holder 62 contains a recess 64 within which a bar of soap may be placed, and also has a rod 65 for supporting a wash cloth and extending horizontally between and supported by two projections 66 extending outwardly from opposite sides of the holder. The lugs 66 project outwardly a substantial distance beyond the plane of wall 63 of the shower or tub area. Two soap mounting projections 34*g* corresponding to projections 34 of FIG. 1, or to the projections of any of the other forms of the invention, are attached to and project outwardly in opposite directions from the two lugs 66 of soap holder 62. These projections 34*g* may be approximately aligned with rod 65, and are inclined in correspondence with projections 34 of FIG. 1. Bars of soap such as those shown in any of FIGS. 1 through 9 may be supported on the projections 34*g* in a condition avoiding contact of most or all of the outer surfaces of the soap with any supporting surface, to thus attain the advantages discussed.

Figure 3:
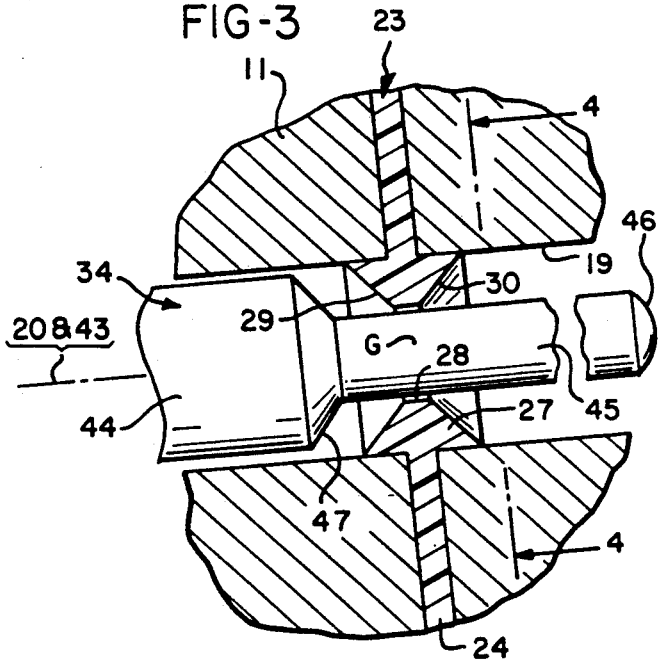
FIG. 3 is an enlarged detail view corresponding to a portion of FIG. 1, but with the stop shoulders of the soap and holder spaced slightly apart for clarity of illustration.
Figure 4:
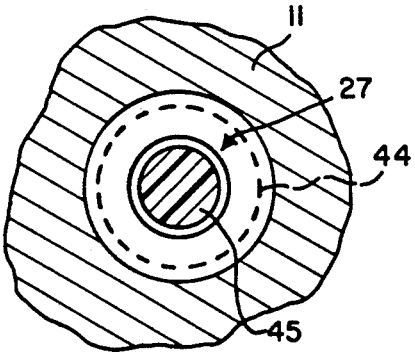
FIG. 4 is a fragmentary transverse section taken on line 4—4 of FIG. 3.
Figure 12:
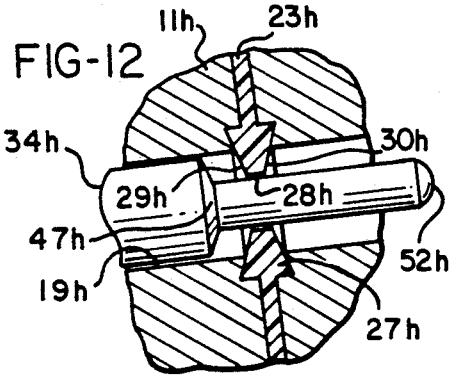
FIG. 12 and 13 are fragmentary vertical sectional views similar to FIG. 3 but showing two other forms of the invention.

FIG. 12 shows fragmentarily another variational bar of soap 11*h* which may be the same as that illustrated in FIGS. 1 to 5 (see particularly FIG. 3) except that the inner thickened annular portion 27*h* of element 23*h* has a greater radial extent than in FIG. 3, so that the frustroconically tapered camming surfaces 29*h* and 30*h* at opposite sides of portion 27*h* and about opening 28*h* extend radially outwardly into and are partially embedded within the material of the bar of soap 11*h* beyond the wall of passage 19*h*. Projection 34*h* of the holder is the same as any of the projections 34 of FIGS. 1 to 5 except that the taper of stop shoulder surface 47*h* may be slightly different than in the first form of the invention and corresponds to the taper of surfaces 29*h* and 30*h* to abut annularly against either of those surfaces. The advantage of the FIG. 12 arrangement is that, if the soap forming the cylindrical passage surface 19*h* in bar 11*h* dissolves partially away to enlarge the diameter of that passage, the tapered camming surfaces 29h and 30h extend far enough radially outwardly to assure camming and centering contact with the spherically rounded extremity 52h of projection 34h.

Figure 13:
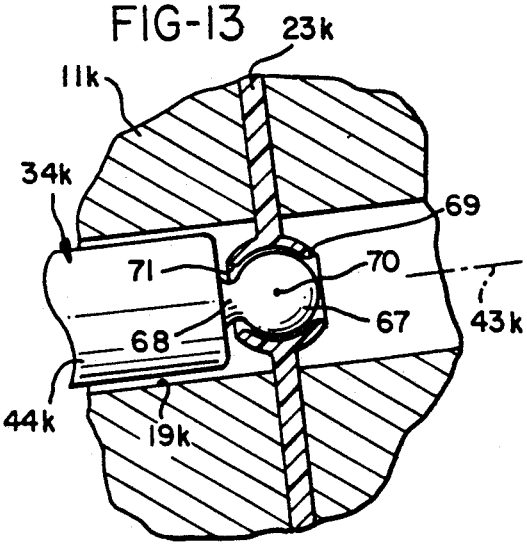

FIG. 13 shows fragmentarily another form of the invention in which the projection 34k is similar to projection 34 of FIGS. 1 to 5 except that the reduced diameter end portion 45 is omitted and a ball shaped detent projection 67 is substituted therefor. This projection 67 is attached to the main portion 44k of projection 34k by a reduced diameter connecting portion 68. The bar of soap 11k of FIG. 13 may be the same as bar 11 of the first form of the invention, containing a passage 19k corresponding to passage 19 of FIGS. 1 to 5, but with element 23k (corresponding to element 23 of FIGS. 1 to 5) having an inner detenting portion 69 shaped to an annular partial spherical configuration as shown. The outer spherical surface of ball 67 and the inner spherical surface of portion 69 are disposed about a common center 70 which is preferably the geometric center and center of gravity of the bar of soap and its element 23k. Portion 69 of element 23k is a fairly tight fit on ball 67 in the FIG. 13 condition in which the bar of soap is retained on projection 34k. However, portion 69 is slightly deformable to enable the ball 67 to be forced axially into and out of portion 69 in a detenting relation. More particularly, as the bar of soap is forced leftwardly along axis 43k of FIG. 13, the annular edge portion 71 of portion 69 of element 23k is expanded slightly by contact with ball 67 to pass the ball into the interior of portion 69 to the position illustrated. Reverse rightward movement of the bar of soap again deflects the edge 71 to a slightly increased diameter to allow the ball to move out of portion 69 in a snap connector relation. Thus, in FIG. 13, the bar of soap is more positively but releasably retained on projection 34k. Other types of snap detent connections may be substituted for the illustrated ball detent arrangement if desired.

While certain specific embodiments of the present invention have been disclosed as typical, the invention is of course not limited to these particular forms, but rather is applicable broadly to all such variations as fall within the scope of the appended claims.

I claim:

1. For use with a bar of soap containing a recess and having outer surfaces soluble in water, a device comprising:

a base adapted to be placed on and supported by a generally horizontally extending upwardly facing counter surface;

a post connected at its lower end to said base and projecting upwardly therefrom; and a projection carried by said post at a location spaced above said base and projecting laterally from the post and constructed to extend into said recess in the bar of soap for movement of the bar of soap onto and off of the projection between a position detached therefrom and a position in which said projection extends into said recess and supports the bar of soap at least in part from its interior to enhance drying of said outer surfaces;

said projection being inclined to advance progressively upwardly as it advances laterally away from said post, in a relation tending to retain the bar of soap on the projection by gravity;

the inclination of said projection being at a small angle very near horizontal, to facilitate viewing of said recess in the soap as it is slipped onto the nearly horizontal projection;

said base being adapted to support the post and projection and a bar of soap on the projection from the counter surface without attachment of the base to the counter surface.

2. A device as recited in claim 1, including a stop shoulder engageable with said bar of soap to limit movement of the bar onto the projection.

3. A device as recited in claim 1, in which said projection has a stop shoulder spaced laterally from said post and engageable with said bar of soap within said recess in a relation limiting movement of the bar of soap onto the projection.

4. A device as recited in claim 1, in which said projection has a stop shoulder spaced laterally from said post and engageable with said bar of soap within said recess in a relation limiting movement of the bar of soap onto the projection and preventing movement of the bar of soap into contact with the post.

5. A device as recited in claim 1, in which said projection has an end portion of a relatively small transverse dimension adapted to extend through an opening in an element carried by said bar of soap within said recess, and has a portion of greater transverse dimension inwardly of said end portion, with a shoulder formed between said end portion and said portion of greater transverse dimension and adapted to engage said element to limit movement of said bar of soap onto the projection.

6. The combination comprising a device as recited in claim 5, and a bar of soap containing a recess and adapted to be supported on said device with said projection extending into said recess.

7. A device as recited in claim 1, including means carried by said projection for forming a snap connection between the projection and said bar of soap to releasably retain the bar of soap on the projection.

8. A device as recited in claim 1, in which there are two of said inclined projections extending laterally in generally opposite directions from said post.

9. A device as recited in claim 1, in which said inclined projection has a camming surface adapted to deflect said bar of soap as it moves onto said projection to cam the soap into a predetermined aligned position with the projection.

10. A device as recited in claim 1, in which said post has a stop surface at an inner end of said projection engageable with an outer surface of said bar of soap to limit movement of the bar of soap onto the projection.

11. A device as recited in claim 1, in which said post has a stop surface having a portion which is inclined to extend essentially perpendicular to said projection for engagement with an outer surface of the bar of soap disposed perpendicular to the projection in a manner limiting movement of the bar of soap onto the projection.

12. A device as recited in claim 1, in which said post has a conically shaped upwardly tapering surface from which said inclined projection extends laterally outwardly and upwardly and which is engagement with an inclined outer surface of said bar of soap to limit movement of the bar of soap onto said projection.

13. A device as recited in claim 1, in which said base is an upwardly concave dish.

14. A device as recited in claim 1, in which said base is a generally horizontally extending upwardly concave dish having a central opening, and said post has a lower portion connected to said dish at said opening.

15. A device as recited in claim 1, including a second projection extending directly upwardly from the upper end of said post above the level of said inclined first mentioned projection and adapted to receive and support a bar of soap.

16. A device as recited in claim 1, in which said post has a conically shaped upwardly tapering surface from which said inclined projection extends laterally outwardly and upwardly and which is engageable with an inclined outer surface of said bar of soap to limit movement of the bar of soap onto said projection; said projection having an end portion of a relatively small transverse dimension adapted to extend through an opening in an element carried by a second bar of soap within a recess in said second bar; said projection having a portion of greater transverse dimension inwardly of said end portion, with a shoulder formed between said end portion and said portion of greater transverse dimension and adapted to engage said element in said second bar of soap to limit movement of said second bar of soap onto the projection and prevent engagement of said second bar with said conically shaped stop surface.

17. A device as recited in claim 1, in which said base is a generally horizontally extending dish; said post having a lower portion connected to said dish near the center thereof; said post having an upper portion with a conically shaped upwardly tapering external surface; there being two of said projections extending laterally in different directions from said conically shaped upwardly tapering surface and both inclined to advance upwardly as they advance laterally outwardly; said conically shaped upwardly tapering surface having portions inclined to extend essentially perpendicular to said projections for line contact with bars of soap received on the projections.

18. A device as recited in claim 17, in which each of said projections has an end portion of a relatively small transverse dimension adapted to extend through an opening in an element carried by an additional bar of soap within a recess therein, and having a portion of greater transverse dimension inwardly of said end portion, with a shoulder formed between said end portion and said portion of greater transverse dimension and adapted to engage said element to limit movement of said additional bar of soap onto each of the projections.

19. A device as recited in claim 18, in which said shoulder formed on each of said projections is essentially annular and tapered to function as a camming surface for centering a bar of soap on each projection.

20. The combination comprising a device as recited in claim 19, and a bar of soap adapted to be supported on either of said projections with the projection extending into a recess in the bar of soap.

21. The combination comprising a device as recited in claim 1, and a bar of soap adapted to be supported on said projection with said projection extending into a recess in the bar of soap.

22. A soap holder which is adapted to be mounted within a cavity in a wall, and which forms a receptacle in the wall within which a bar of soap or other item may be placed;

two mounting lugs projecting outwardly beyond the wall at opposite sides of said soap holder;

a rod extending between said two lugs outwardly beyond the wall to receive a washcloth supported on the rod; and a projection carried by one of said lugs at a side thereof facing away from said rod and projecting from that lug in a direction away from the rod and adapted to extend into a recess in a bar of soap for supporting a bar of soap on the projection.

23. A soap holder as recited in claim 22, in which there are two of said projections carried by said two lugs respectively and projecting in opposite directions away from said rod.

24. A soap holder as recited in claim 22, in which said projection is inclined to advance progressively upwardly as it advances away from said rod.

25. A soap holder as recited in claim 22, in which said projection has an outer end portion of relatively small transverse dimension and an inner portion closer to the lug by which it is carried and of increased transverse dimension, with a shoulder formed between said outer and inner portions for limiting movement of a bar of soap onto the projection.

26. A soap holder as recited in claim 22, in which there are two of said projections extending in opposite directions from said two lugs respectively and away from said rod; each of said projections being inclined to advance progressively upwardly as it advances away from the lug by which it is carried; each of said lugs having an outer end portion of relatively small transverse dimension and an inner portion of greater transverse dimension, with a shoulder formed between said outer and inner portions for limiting movement of a bar of soap onto each of the projections.

* * * * *